United States Patent [19]

Dashew

[11] 3,931,952

[45] Jan. 13, 1976

[54] MULTIPLE CONCRETE FORM APPARATUS

[75] Inventor: Stephen S. Dashew, Palos Verdes Estates, Calif.

[73] Assignee: Interform, Inc., Compton, Calif.

[22] Filed: June 11, 1973

[21] Appl. No.: 368,716

Related U.S. Application Data

[62] Division of Ser. No. 219,060, Jan. 19, 1972, Pat. No. 3,804,930.

[52] U.S. Cl. ..... 249/177; 264/334

[51] Int. Cl.[2] ..... B28B 7/28

[58] Field of Search ..... 249/119, 122, 176, 177, 249/129, 131, 139, 23, 123, 66, 66 A, 163, 178, 212, 184, 210, 211, 212, 175, 178, 28–32, 183; 264/318, 334, 336

[56] References Cited

UNITED STATES PATENTS

| | | | |
|---|---|---|---|
| 1,655,629 | 1/1928 | Senesac | 249/184 X |
| 1,846,195 | 2/1932 | Goldsmith | 249/31 |
| 1,985,115 | 12/1934 | Straub | 264/334 X |
| 2,190,807 | 2/1940 | Steinberger | 264/324 X |
| 2,570,384 | 10/1951 | Russell | 249/166 X |
| 2,734,250 | 2/1956 | Thompson | 249/28 X |
| 2,754,708 | 7/1956 | Peterson | 269/266 X |
| 2,775,019 | 12/1956 | Bemis | 249/31 X |
| 3,294,358 | 12/1966 | Hagedorn | 249/175 |
| 3,295,280 | 1/1967 | Kettner | 52/378 |
| 3,640,040 | 2/1972 | MacLean | 249/28 X |
| 3,740,178 | 6/1973 | Neil | 249/177 |

*Primary Examiner*—Francis S. Husar
*Assistant Examiner*—John S. Brown
*Attorney, Agent, or Firm*—Lindenburg, Freilich, Wasserman, Rosen & Fernandez

[57] ABSTRACT

Apparatus for forming concrete buildings that have numerous identical portions, which minimizes the set-up time for a group of forms, by permitting the forms to be individually released from set concrete while constantly maintaining the positions of the forms on a subform. The apparatus includes several forms with flanges that rest on a subform, several bolts for each form that project through flanges of the forms and through holes in the subform, and a spring for each bolt to urge its lower end downwardly with respect to the subform. After concrete is poured on the forms and partially sets, the subform is lowered a few inches even though the forms may remain stuck in the concrete, and then each form is individually freed from the concrete. As each form is freed, the bolts guide it down to its original position on the subform. The subform and forms then can be moved as a unit to a new location in the building where another identical concrete portion is to be formed.

6 Claims, 5 Drawing Figures

MULTIPLE CONCRETE FORM APPARATUS

This is a division of application Ser. No. 219,060 now Pat. No. 3,804,930 filed 1/19/72.

BACKGROUND OF THE INVENTION

Field of the Invention

This invention relates to structural concrete forming apparatus and methods.

Multi-story buildings are often constructed with poured concrete floor structures. In many cases, a sturdy subform is installed, several dome or pan-shaped forms are mounted on the subforms, and concrete is poured over the forms and allowed to partially set. The subform and the forms thereon are removed from the concrete and reinstalled for pouring another concrete structure. The same structure may be repeated several times for each story of the building, and many of the stories of the building may be identical, so that it is possible to utilize a single subform with several forms thereon to form a large part of the building.

A large part of the labor involved in constructing the poured concrete floors arises in handling of the several forms and subforms, that is, in moving them from one place to another and in accurately mounting the forms on the subforms for each pouring. If all of the forms could be bolted to the subform so that the entire apparatus could be moved and positioned as a single unit for each pouring of concrete, then the labor involved could be reduced significantly. However, difficulty is experienced in attempting to remove all of the forms simultaneously from set concrete. The forms are often stuck to the concrete, so that if the subform is lowered as a unit any stuck form may be broken. Actually, when several forms stick they may support the entire bay of forms and the subform, and if only one form at one side sticks, it may hold up only one end of the bay of forms and cause tilting of the assembly that causes the forms to bind as they start to move down. The forms can be freed by shaking them back and forth and by blowing air through holes provided in the forms as they are pulled down. However, great difficulties would be encountered in trying to simultaneously free all of the forms that are mounted on a subform as the subform is lowered.

BRIEF DESCRIPTION OF THE INVENTION

In accordance with the present invention, a method and apparatus is provided for forming many identical concrete structures by enabling numerous forms to remain attached to a subform during removal of the forms from set concrete, so that the subform with forms thereon can be rapidly moved to a new location without the need for reassembly. Each form is attached to the subform by fasteners that maintain the lateral position of each form over the subform while permitting a limited vertical movement of the form relative to the subform. The fasteners hold the forms down against the subforms until the concrete is set. The subform is then lowered a few inches while any stuck form can remain in place in the concrete. The forms that are stuck in the concrete can be individually freed using air hoses and shaking procedures until they can drop down. As each form drops down onto the subform, the fasteners assures that the form will return to its original position thereon without the need for workmen to shift the form to its proper position and refasten it. Thus, it is only necessary to free all of the forms and then move the entire assembly to the new location.

In one assembly, the forms have flanges that normally rest on the subform, and the fasteners includes bolts that project through holes in the flanges of the forms and through holes in the subform. Springs are mounted at the bottoms of the bolts to urge them downwardly so that they tend to pull the forms down against the subform. However, if a form is stuck in place when the subform is lowered a few inches, then the bolts do not move down and the springs are compressed to resiliently urge down the bolts, and therefore the forms also. When the forms are freed from the concrete, they move down against the subform, the bolts assuring that they will return to their original positions thereon.

The novel features of the invention are set forth with particularity in the appended claims. The invention will best be understood from the following description when read in conjunction with the accompanying drawings.

DESCRIPTION OF THE PREFERRED EMBODIMENT

Figure 1:
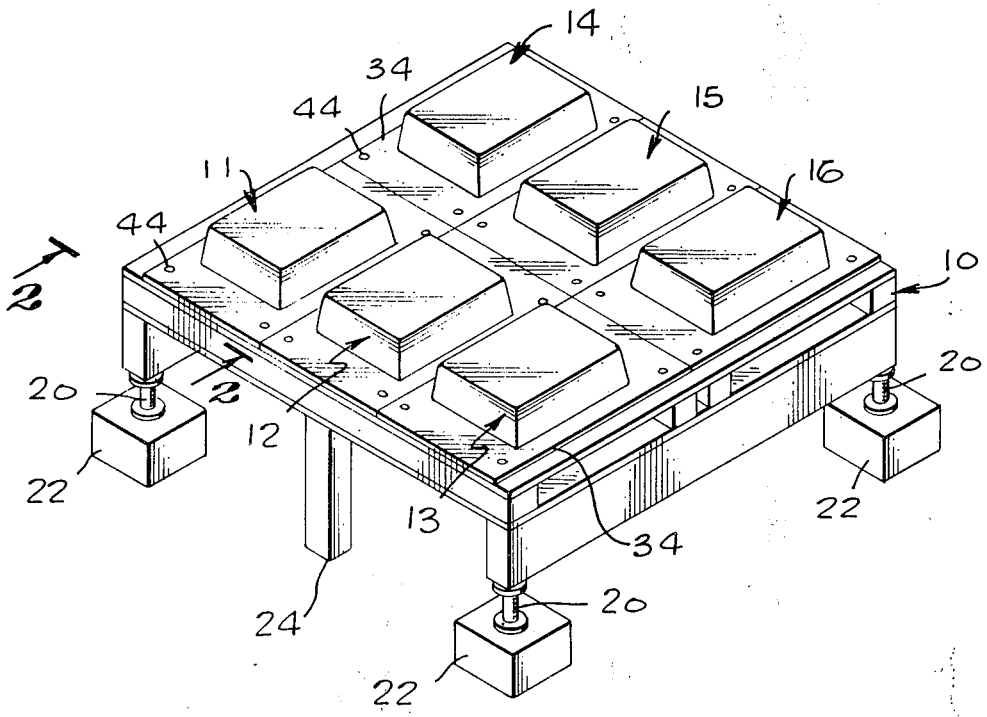
FIG. 1 is a perspective view of a form assembly constructed in accordance with the invention, which is shown in place and ready for the pouring of concrete.

FIG. 1 illustrates a form apparatus which has been set up to form a concrete structure such as a portion of the floor of a building. The apparatus includes a subform 10 and several pan-shaped forms 11–16 mounted on the subform. This arrangement of pans can be utilized to construct a poured concrete floor with concrete beams that are integral with the floor. The subform 10 is supported by several jacks 20 that rest on reinforced boxes 22, and also by several posts 24. After the apparatus is set, concrete is poured over the forms 11–16 to a height several inches above the top walls of the forms, to construct a concrete floor with integral beams. It should be noted that reinforcing bars are positioned before the pouring of concrete, and the form structure is generally constructed so that the poured concrete merges with any previously poured concrete portions and with supporting columns and the like. Such additional apparatus is well known in the art, and is not shown herein in order to simplify the explanation of the invention.

After concrete has been poured over the forms and has partially set, the subform 10 with the forms 11–16 thereon may be removed and reused. The building for which the floors are constructed may be designed with many substantially identical floors, and each floor may utilize several floor sections that each can be formed by the group of forms 11–16. Thus, after the subform 10 with the forms 11–16 thereon has been removed from set concrete, it can be reinstalled in another region of the building, often with no modification, for a new pouring of concrete. This can be accomplished with a minimum of labor, if the forms 11–16 can be removed with the subform 10 from the set concrete without requiring that the forms be repositioned and refastened to the subform. The present invention provides apparatus for mounting the forms on the subform in a manner that facilitates removal from set concrete so that the forms do not have to be repositioned and refastened on the subform.

Figure 2:
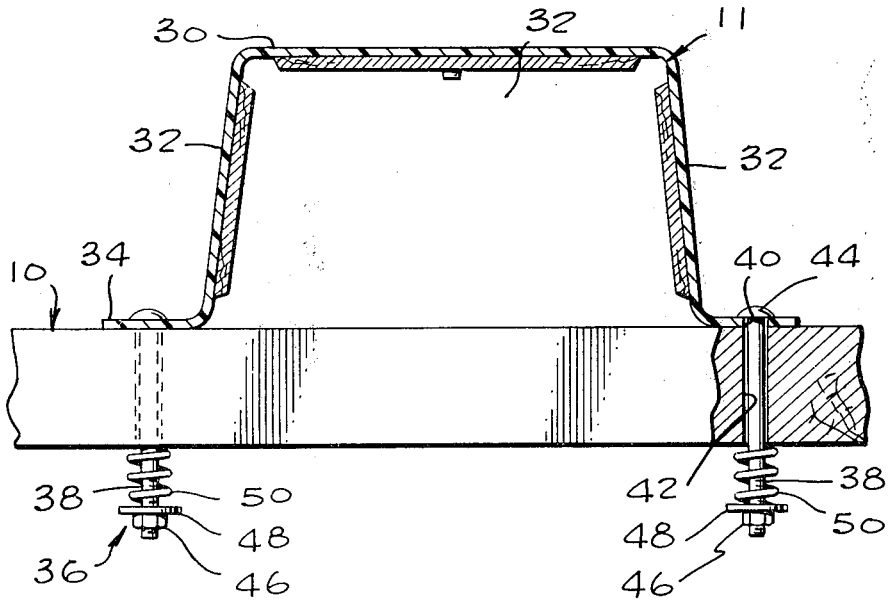
FIG. 2 is a partial sectional view taken on the line 2—2 of FIG. 1.

As illustrated in FIG. 2, each of the forms, such as form 11, has a horizontally extending base wall 30, four side walls 32 extending in a primarily vertical direction from the base wall, and a flange 34 that extends around the lower ends of the side walls. The flanges 34 of the form rest on the subform 10 and support the rest of the form thereon. The form is mounted by fastener assemblies 36 on the subform 10, the fastener assemblies 36 serving to accurately fix the lateral or horizontal position of the form 11 relative to the subform 10 while permitting considerable vertical movement of the form relative to the subform. The fastener assembly 36 includes a bolt 38 with a shank that projects through a hole 40 in the flange and through a hole 42 in the subform, and with a head 44 that rests on top of the flange. The head can be of the flat type that lies in a corresponding countersink recess in the form, if it is desired to eliminate bolt-caused recesses in the finished concrete. A nut 46 and washer 48 are held to the lower end of the bolt, and a coil spring 50 is disposed about the shank and held between the washer 48 and subform 10. The spring 50 urges the lower portion of the bolt downwardly with respect to the subform 10, and therefore causes the bolt 38 to urge the flance 34 of the form down against the subform, Each of the forms is mounted by four fastener assemblies 36 to the subform 10. The forms are constructed with four spaced holes in their flanges, and a bolt 38 projects through each of the holes in the flanges and through aligned holes in the subform 10. A separate coil spring 50 is provided to resiliently held down each of the bolts. The bolts 38 fix the lateral, or sideward position of the form with respect to the subform, while permitting relative vertical movement of the form with respect to the subform. If the subform 10 is moved downwardly a few inches while the form 11 is prevented from moving down because it is trapped in set concrete, there is no damage to the form. This is because the subform can slide along the shanks of the bolts 38. Such relative vertical movement results of compression of the springs 50, which thereafter urge the form downwardly towards the subform, which is useful in later freeing the form. The bolts 38 continue to maintain the form 11 at a fixed lateral position over the subform, and when the form is freed the bolts 38 guide it downwardly back to its original position on the subform. The use of several bolts spaced about the form helps to avoid excessive tilting of the forms as they are lowered.

Figure 3:
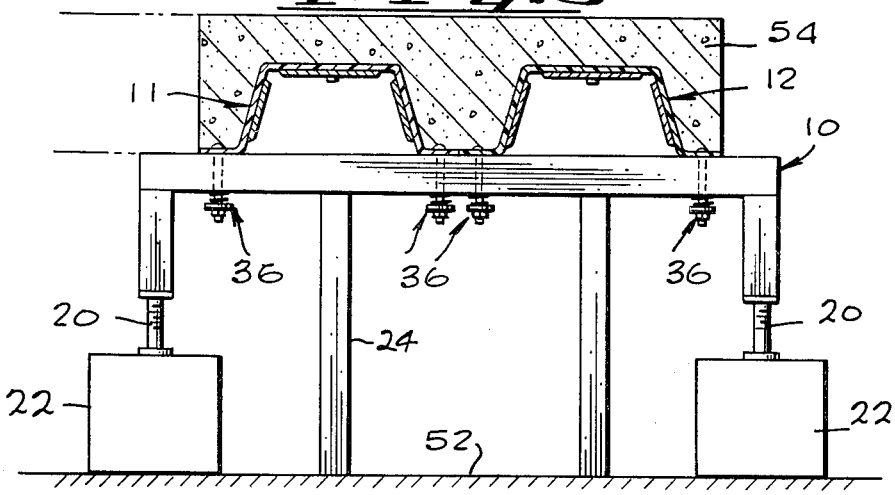
FIG. 3 is a sectional view of the apparatus of FIG. 1 showing it after concrete has been formed thereon.
Figure 4:
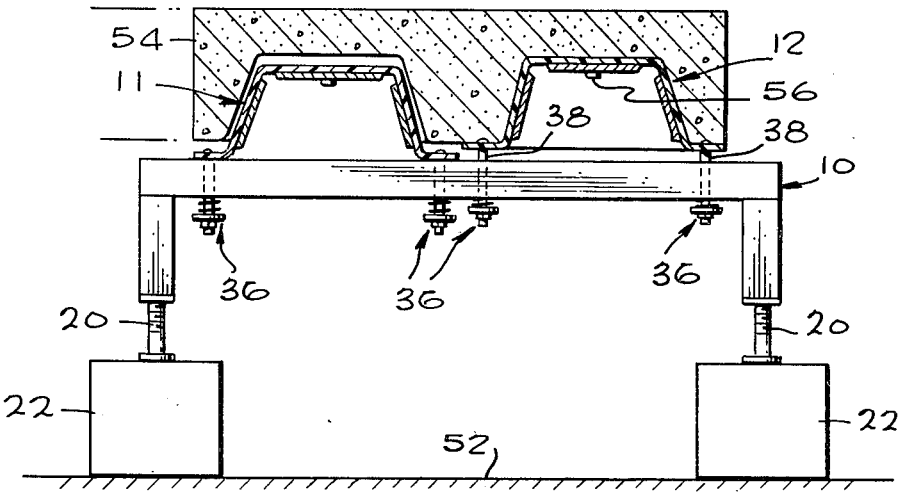
FIG. 4 is a view similar to FIG. 3, but showing the apparatus during its removal from set concrete.
Figure 5:
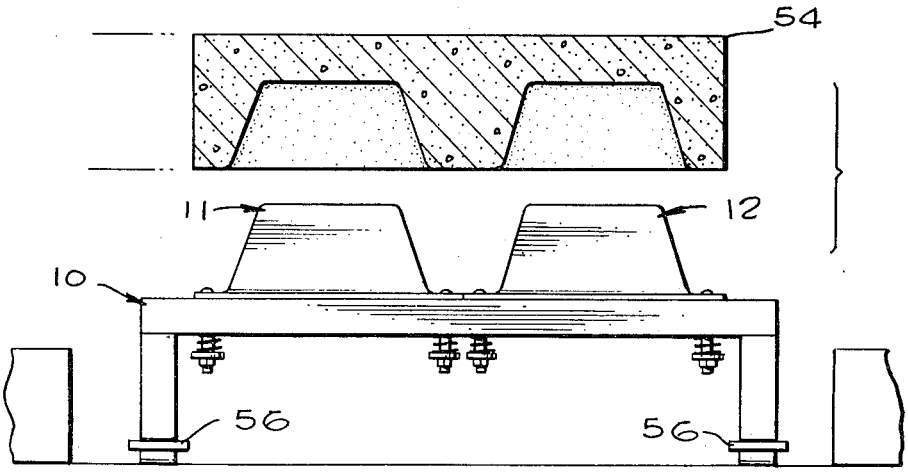
FIG. 5 is a view similar to FIG. 4, but showing the apparatus after its complete removal from set concrete.

FIGS. 3–5 illustrates a method for forming concrete structures utilizing the apparatus of the invention. The apparatus is set up on a previously poured floor or other structure 52, and concrete 54 is poured over the forms to construct a floor with integral beams. After the concrete partially sets, the supporting posts 24 are removed and the jacks 20 are operated to lower the subform 10 by perhaps an inch or two. In FIG. 4, one of the forms 11 is shown as stuck in place in concrete. If the form 12 had been rigidly bolted to the subform 10, then its flanges might have been broken if it did not immediately release from the concrete. However, in the present invention the bolts 38 that attach the form 12 to the subform are allowed to move up relative to the subform, and this merely results in compression of the springs 50 that urge the bolts downwardly with respect to the subform. Those forms that are stuck in the concrete can be individually released. This is often accomplished by connecting an air hose to a nipple 56 in the upper face of the form to blow air therethrough, and also by shaking the form while pulling it downwardly by handles (not shown) located within the form. As each form is released, it drops down onto the subform 10, the bolts 38 serving to accurately guide the forms back to their original positions and helping to prevent tilting and binding of the forms as they begin to move down. The springs 50 aid in the removal of the forms by applying downward forces to the forms that help to pull them down out of the set concrete. If any form cannot be removed, it can be unbolted from the subform so that the entire set of forms is not tied up.

After each of the forms has been removed from the set concrete, the subform 10 with the forms thereon can be lowered to the position shown in FIG. 5 and onto dollies 56 for removal to the next position at which a concrete floor section is to be poured. Of course, downward movement of the subform 10 requires that the jacks 20 and boxes 22 be first removed. In many cases, this is accomplished by the use of a special hydraulic hoist. The hoist may be placed under the subform 10 after it has been lowered a few inches by the screw jacks 20, and the subform 10 may then be raised enough to allow the jacks and the boxes 22 to be removed. After the forms have been individually removed from the set concrete, the hoist can then lower the entire assembly onto the dollies. The assembly can then be rolled to a position where a crane can lift it and set it down at the next position where a floor section is to be poured. The entire subform 10 with the several forms thereon is handled as a unit so that such handling can be accomplished with a minimum of labor. Each of the forms 11–16 may weigh several hundred pounds, while the subform 10 may weigh several times as much. Thus, if each form and the subform had to be handled separately, a crane might be required in each handling, particularly where the apparatus is to be raised to a new floor of a building. By enabling all of the forms and the subform to be handled as a single unit, movement of the apparatus is simplified and is accomplished more economically.

Thus, the invention provides a method and apparatus for the forming of concrete, by minimizing the labor involved in set up and moving of the apparatus. This is accomplished by utilizing fastener assemblies for holding forms to the subform, which permits limited vertical movement of the forms with respect to the subform while maintaining a substantially fixed lateral position of each form with respect to the subform. This permits the subform to be lowered after concrete sets, even though some or all of the forms may be stuck in the concrete, and permits each of the forms to be individually released from the set concrete. Bolts or other elongated members serve to guide the forms to their original positions while springs encourage such return and also provide downward forces that help in the removal of the forms from set concrete. Of course, a variety of subform apparatus can be utilized as well as a variety of form types and arrangements on the subform.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. Apparatus for forming concrete comprising:

a subform;

a plurality of forms with lower portions resting on said subform, each form having a base wall and at least two side walls extending with vertical directional components from the base wall for supporting concrete poured thereon; and a plurality of spaced fastener means for confining each of said forms to a predetermined lateral position with respect to said subform and preventing rotational movement of the form with respect to the subform, while permitting relative vertical movement of each of said forms and their lower portions with respect to said subform form independently of relative vertical movement of other forms to the subform within a limited distance of at least one inch of vertical movement, whereby to prevent loss of a stuck form from the subform while permitting sufficient vertical movement to allow the subform and unstuck forms thereon to strip away from set concrete.

2. The apparatus described in claim 1 wherein:

each of said forms has at least two horizontal flanges extending from the bottom of each side wall; and said plurality of fastener means which confines a form to said subform comprises at least four spaced elongated members extending through said flange on the form and through a portion of said subform, for resisting tilting of the form in any direction when there is relative vertical movement of the form to the subform.

3. The apparatus described in claim 1 including:

at least one spring resiliently urging each form downwardly towards said subform.

4. Apparatus for forming concrete comprising:

a subform;

a plurality of forms disposed on said subform for supporting poured concrete, each form having a base wall, at least two side walls extending with vertical directional components from the base wall, and a flange section extending laterally from each side wall; and a plurality of fastener means confining said forms to predetermined lateral positions with respect to said subform while permitting relative vertical movement of each of said forms to said subform independently of relative vertical movement of other forms to the subform;

said fastener means including a plurality of elongated menbers, each having an upper end engaged with one of said flange sections and a lower portion slideably engaged with said subform, and a plurality of springs, each spring urging the lower portion of one of said elongated members downwardly with respect to said subform.

5. Apparatus for forming concrete comprising:

a subform having a plurality of holes;

a plurality of pan-shaped forms, each having an upper wall, four side walls extending with downward directional components from said upper wall, and a flange extending around the bottoms of said side walls, each of said flanges having a plurality of holes spaced about its periphery, and the flanges of all of said forms lying over said subform with the holes in said flanges aligned with the holes in said subform;

a plurality of elongated fasteners with enlarged upper end portions resting on said flanges, said fasteners having portions extending through said holes in said flanges and having portions slideably extending through said holes in said subform to maintain said forms in positions on said subform wherein the holes in the flanges are aligned with holes in the subform; and a plurality of springs, each coupled to said subform and to one of said elongated fasteners to urge the elongated fasteners downwardly while permitting them to move up relative to the subform.

6. Apparatus for forming concrete comprising:

a subform having a plurality of holes;

a plurality of pan-shaped forms, each having an upper wall, four side walls extending with downward directional components from said upper wall, and a flange extending around the bottoms of said side walls, each of said flanges having a plurality of holes spaced about its periphery, and the flanges of all of said forms lying over said subform with the holes in said flanges aligned with the holes in said subforms; and a plurality of elongated fasteners with enlarged upper end portions resting on said flanges, said fasteners having portions extending through said holes in said flanges and having portions slidably extending through said holes in said subform, to maintain said forms in positions on said subform wherein the holes in the flanges are aligned with holes in the subform, while permitting vertical movement of each form with respect to the subform, said fasteners being long enough to permit a limited vertical movement at least on the order of one inch of said forms relative to said subform.

* * * * *